United States Patent [19]

Schildge, Jr.

[11] Patent Number: 4,651,496

[45] Date of Patent: Mar. 24, 1987

[54] METHOD OF ERECTING A CABLE STAY ROOF OVER AN EXISTING STRUCTURE

[76] Inventor: Adam T. Schildge, Jr., 899 Green St., San Francisco, Calif. 94133

[21] Appl. No.: 843,678

[22] Filed: Mar. 25, 1986

[51] Int. Cl.[4] ..... E04H 3/12

[52] U.S. Cl. ..... 52/747; 52/73; 52/83; 52/6

[58] Field of Search ..... 52/83, 80, 6, 82, 741, 52/745, 747, 73; 135/105, 97; D25/1, 6, 21, 32, 56

[56] References Cited

U.S. PATENT DOCUMENTS

De. 274,891 7/1984 Schildge ..... D25/6
2,692,566 10/1954 Mitchell ..... 135/97
2,837,101 6/1958 Bary ..... 52/83

FOREIGN PATENT DOCUMENTS 611172 12/1960 Canada ..... 52/80

*Primary Examiner*—John E. Murtagh
*Attorney, Agent, or Firm*—Limbach, Limbach & Sutton

[57] ABSTRACT

A method is disclosed for erecting a cable stay roof structure. The cable stay roof structure is intended to be assembled above an existing open air stadium. The structure includes an A-frame which supports a plurality of radial beams via cable stays. A covering, preferably of glass, is mounted over the radial beam structure. The covering can have a partially retractable panels. The load of the roof structure is carried by the A-frame, rather than by the existing stadium walls.

12 Claims, 17 Drawing Figures

FIG. 14
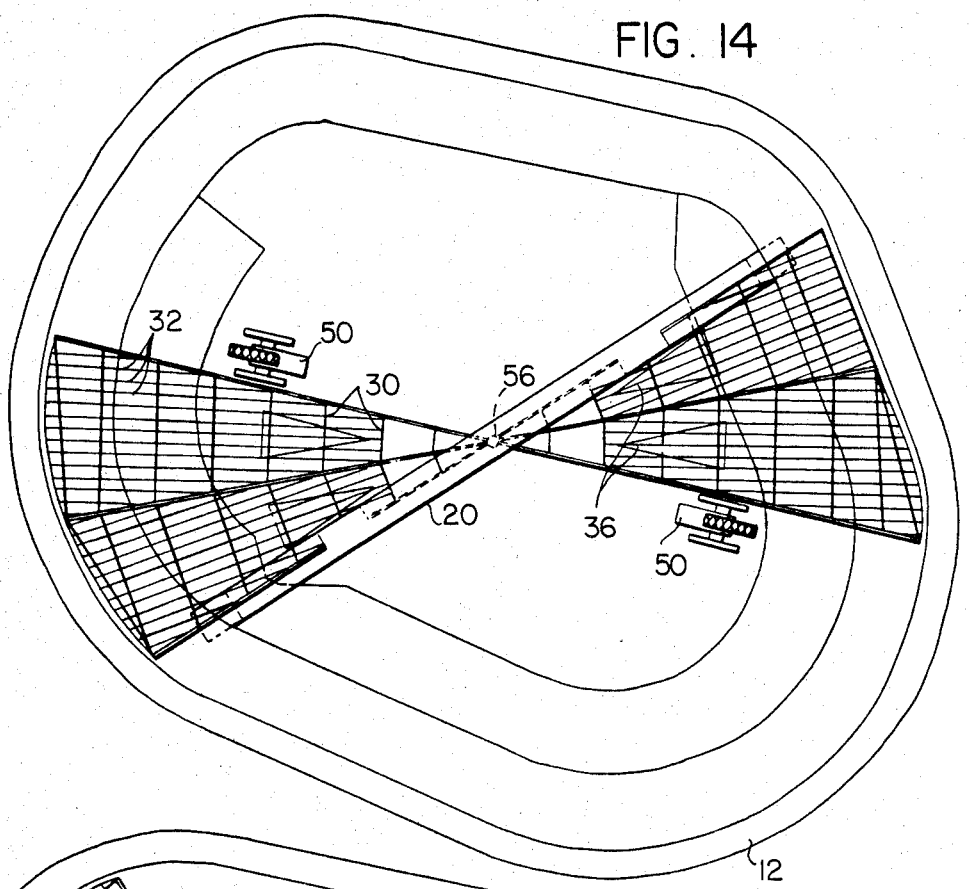
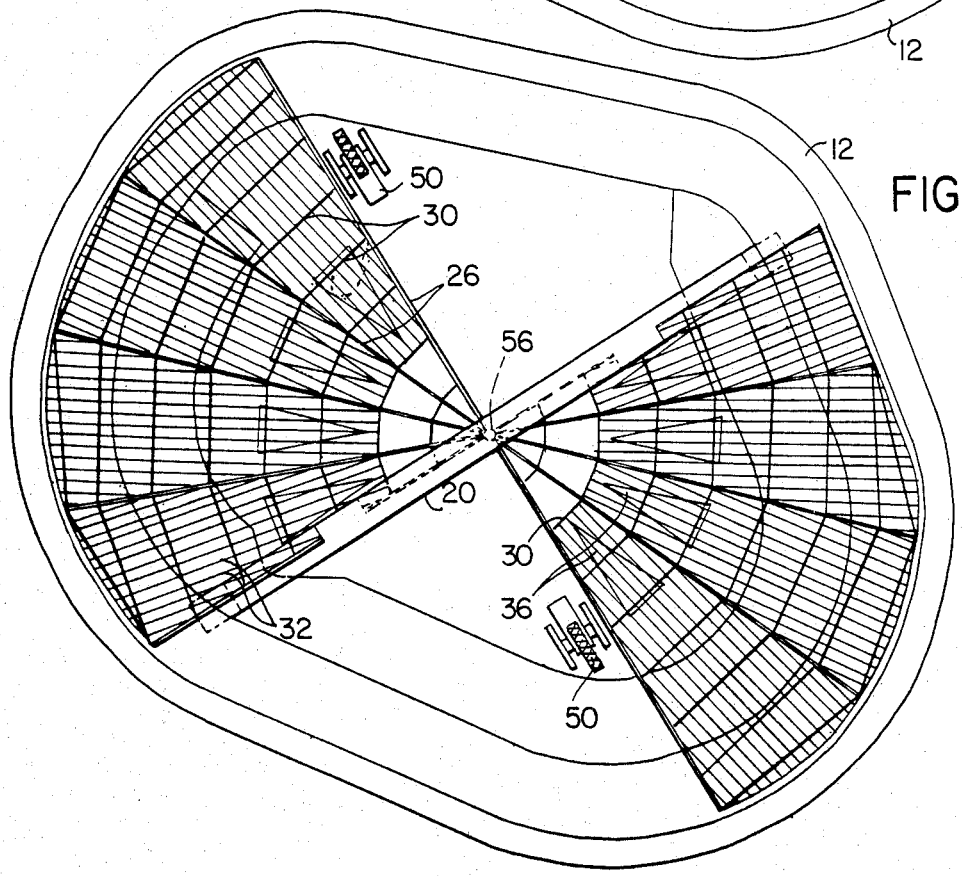
FIG.15

METHOD OF ERECTING A CABLE STAY ROOF OVER AN EXISTING STRUCTURE

TECHNICAL FIELD

The subject invention relates to a method of constructing a roof over a preexisting open air stadium. The roof is supported from an A-frame by cable stays such that the existing structure carries none of the load of the roof.

BACKGROUND OF THE INVENTION

The erection of structures utilizing suspension cables or cable stay technology has existed for quite some time. For example, many bridges utilize cables extending between towers to suspend a roadway. In addition, many buildings have been designed such that the roof structures are supported by cables. The principle advantage of utilizing cables to support roofs is that large covered buildings can be designed without any internal supports. One example of a structure which benefits from this type of design is an airplane hanger which requires large areas without pillars to permit positioning aircraft. Sporting arenas also benefit from this design since it provides for unobstructed viewing.

Examples of roof structures designed by the applicant with cable stay technology can be found in the following U.S. Pat. Nos., Des. 260,036, issued July 28, 1981; Des. 270,570, issued Sep. 13, 1983; Des. 274,841, issued July 24, 1984; Des. 274,842, issued July 24, 1984; and Des. 274,843, issued July 24, 1984.

The latter patents relate to the ornamental appearance of cable stay supported structures. In contrast, the subject invention is directed to a method for constructing a cable stay roof structure on top of an existing structure.

Recently, there has been significant amount of interest in covering existing, open air athletic stadiums. As can be appreciated, many stadiums are located in areas where the elements make it difficult to hold events on year-round basis. Unfortunately, existing open air stadiums are not designed to support the weight of a newly added roof. Thus, in order to build a roof over an existing stadium, significant measures have to be taken to reinforce the stadium walls or build an additional support system. The latter steps, even if possible, can be difficult and expensive.

Accordingly, it is an object of the subject invention to provide a new and improved method for constructing a roof over an existing stadium.

It is another object of the subject invention to provide a new and improved method for constructing a cable stay supported roof which does not place any additional weight on the existing structure.

It is a further object of the subject invention to provide a new and improved method of constructing a cable stay roof structure which will provide relatively unobstructed viewing within a stadium.

It is still another object of the subject invention to provide a new and improved method of constructing a cable stay roof structure which is capable of supporting a partially retractable cover.

SUMMARY OF THE INVENTION

In accordance with these and many other objects, the subject invention provides for a method of constructing a roof over an existing stadium. The illustrated embodiment corresponds to the ornamental design shown in U.S Pat, No. De. 274,841 cited above. By following the steps of the subject invention, such a structure can be fabricated over a previously existing stadium.

The assembly of the subject roof structure is accomplished by initially erecting a frame within the stadium. The frame is defined by a pair of tower legs which meet at an apex to define an A-frame configuration. The apex is aligned with the center of the stadium and located above the plane of the stadium walls. A plurality of radial beams are suspended from the A-frame by cable stays. A plurality of chordal cross beams are affixed to adjacent radial beams to provide lateral stability and roof support. The radial outer ends of the radial beams are anchored relative to the stadium to provide stability. A covering is affixed over the interconnected beam structure. The finished roof is supported solely by the A-frame and adds no weight to the existing stadium.

BRIEF DESCRIPTION OF THE DRAWINGS

Further objects and advantages will become apparent from the following detailed description taken in conjunction, with the drawings in which:

FIGS. 8 through 11 illustrate the suspension of a first pair of opposed radial beams from the A-frame, with FIGS. 8, 9, and 11 being shown in elevation, while FIG. 10 is a top plan view.

FIGS. 14 through 16 are top plan views illustrating successive steps taken to complete the roof structure.

DETAILED DESCRIPTION OF THE PREFERRED EMBODIMENT

Figure 2:
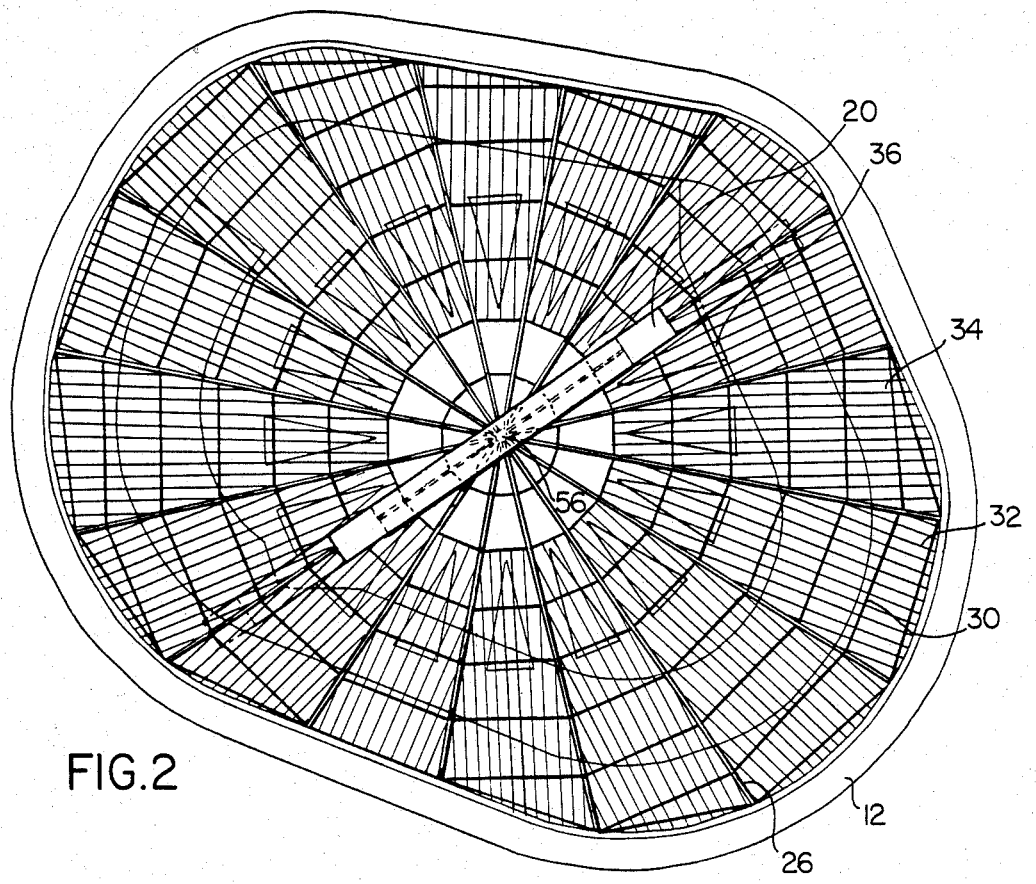
FIG. 2 is a top plan view of the cable stay roof structure of the subject invention.
Figure 1:
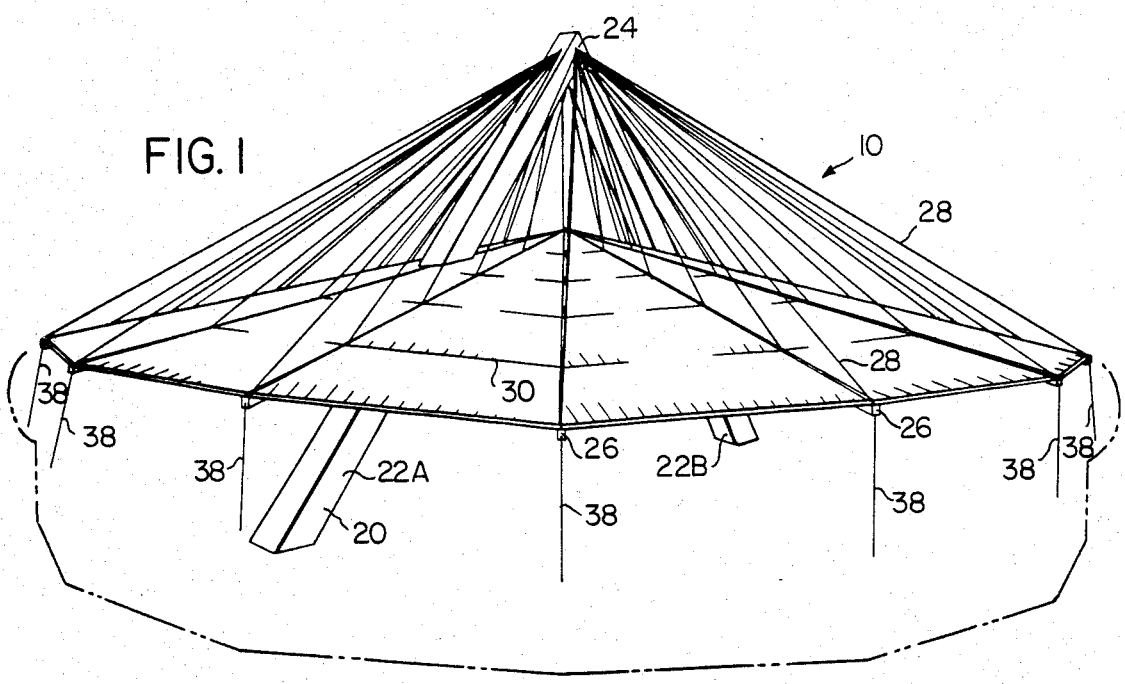
FIG. 1 is a perspective view of the cable stay roof structure of the subject invention.
Figure 17:
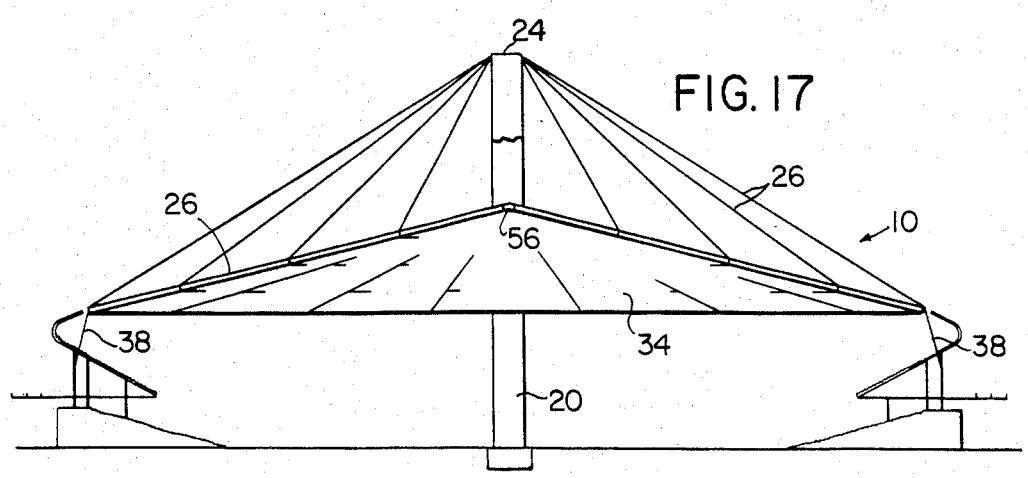
FIG. 17 is a cross sectional view taken along the line 17—17 in FIG. 16, illustrating the completed roof structure of the subject invention showing supporting cables of one pair of opposed radial beams only.

Turning first to FIGS. 1, 2 and 17, the basic elements of the cable stay roof structure 10 of the subject invention will be briefly discussed. The cable stay roof structure 10 is intended to cover an existing, open air stadium shown generally by the numeral 12. The cable stay roof structure 10 is supported by an A-frame 20 having a pair of legs 22A and 22B joined at an apex 24. A plurality of radial beams 26 are supported from the apex 24 of the A-frame 20 by tensioned cable stays 28.

The roof structure further includes a plurality of chordal cross beams 30 extending between and connected to adjacent radial beams 26. A plurality of radially extending purlins 32 are connected to the chordal cross beams to further reinforce the structure. Cover panels 34, which may be formed from glass, are affixed over the beams and purlins. In the preferred embodiment, slidable triangular sections 36 are provided. These triangular sections 36 can be retracted, as illustrated in FIG. 2, to partially open the stadium roof to the air. In inclement weather, these sections can be slid radially inwardly to seal the roof.

The entire roof structure is secured relative to the stadium by tensioned tie down cables 38, as seen in FIG. 17. The tensioned tie down cables provide lateral support for both the A-frame and the roof structure while allowing some movement in high winds or earthquake conditions. As can be appreciated, the A-frame provides full support for the roof and no load is placed on the stadium.

Having identified the main elements of the cable stay roof structure 10, the preferred method of assembling the structure, within an existing stadium, will now be described in detail. FIGS. 3 through 7 illustrate one method of erecting the A-frame 20. In the illustrated embodiment, the A-frame 20 is located entirely within the stadium. Where smaller stadiums are to be covered, it may be economically feasible to locate the base of the tower legs outside the perimeter of the stadium in such a manner that no seating views will be blocked. The placement of the tower legs within the stadium will obstruct the view for a small portion of the seating, but will greatly reduce the overall cost of the construction of the roof.

Figure 3:
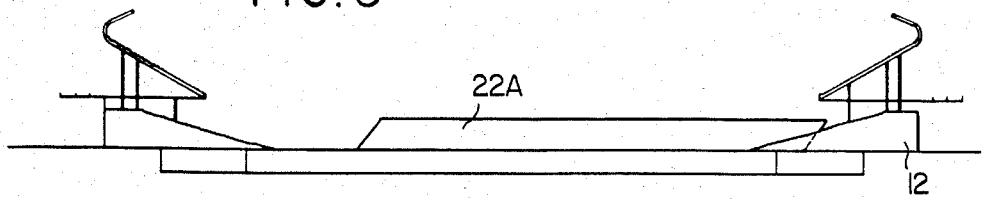
FIGS. 3 through 7 are elevational views of the successive steps taken to erect the A-frame structure within the stadium.
Figure 4:
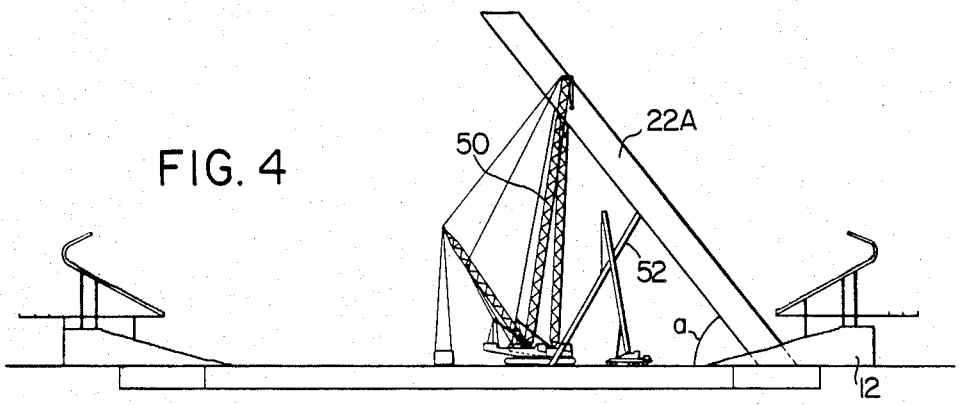

As illustrated in FIG. 3, a first tower leg 22A is placed in a horizontal position on the stadium floor. The tower leg may be preformed and transported to the stadium or fabricated within the stadium. The legs may be formed from steel or concrete.

Figure 5:
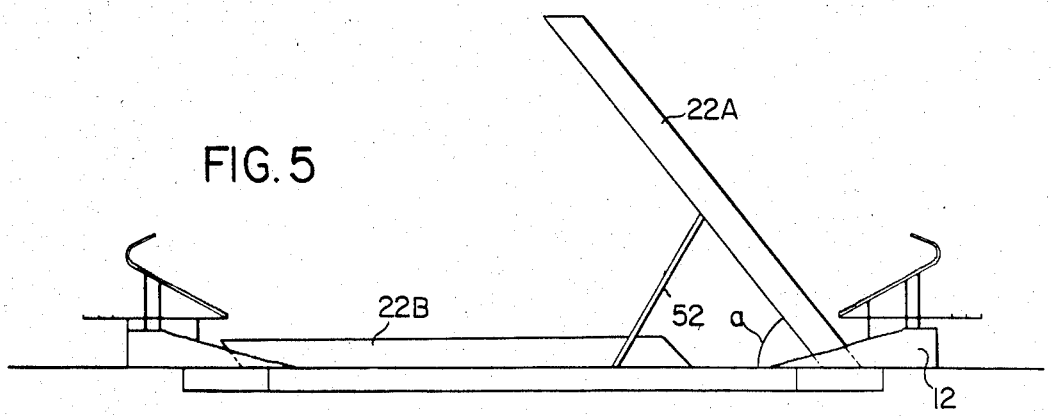
Figure 6:
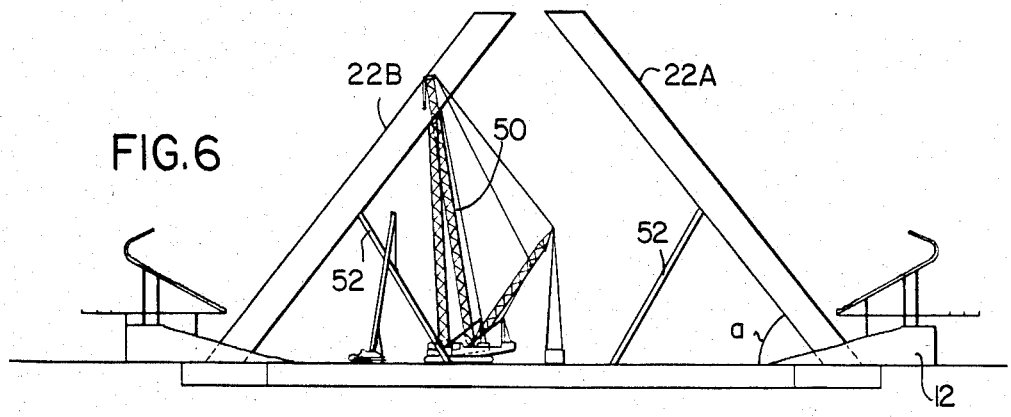
Figure 7:
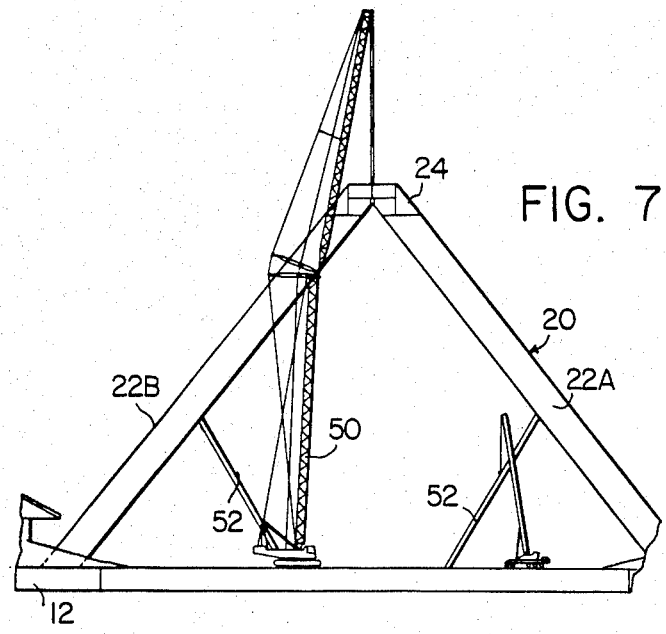

Prior to raising the tower legs, piles should be driven down into the bed rock below the stadium to insure that the A-frame will be firmly supported. Thereafter, a crane 50 can be used to raise leg 22A into an upright position. As an interim measure, a support strut 52 is mounted to hold leg 22A in place. The angular elevation "a", between the stadium floor and the tower legs 22 is on the order of 50° to 55°. The second tower leg 22B is raised in a similar manner, as illustrated in FIGS. 5 and 6. After the two tower legs are erected, an apex or keystone 24 is raised by crane 50 into place and secured to the upper ends of the legs. Once the keystone 24 is secured in place, the struts 52 may be removed. Lateral support for the A-frame will be provided by the tie down cables 38, as shown in FIG. 17, and discussed in more detail below.

If the crane capacity is insufficient to lift the tower legs as a unit, the legs can be raised in the same manner but in multiple units. Each unit would be the full length of the tower leg and then the units would be bolted and welded together in the inclined position to form one complete inclined tower leg (22A, 22B). With the two inclined tower legs in place the keystone (24) is placed to complete the frame.

Other construction techniques may be suitable for erecting the A-frame. For example, the legs may be erected in segmented box form of lengths shorter than the full length of the leg and affixed in place. This approach may be used with steel or concrete. Another approach would be to fabricate the tower legs with a concrete slip-forming technique. Construction of structural members through a slip-forming technique is known in the art and includes the steps of filling in a form with concrete and allowing the concrete to cure or solidify. The form may then be successively raised and filled until the entire leg is formed.

The tower supporting the roof in the subject invention need not necessarily be in the form of an A-frame or inverted V. For example, in a given stadium, it may be desirable to use more than two legs to define a tripod configuration. Also, if more separation is desired between the base of each of the two tower legs, an arch-type configuration could be used. While an arch shape would be more expensive to construct, it might allow the legs to be located outside the perimeter of the stadium and therefore avoid obstructing any seating.

Figure 8:
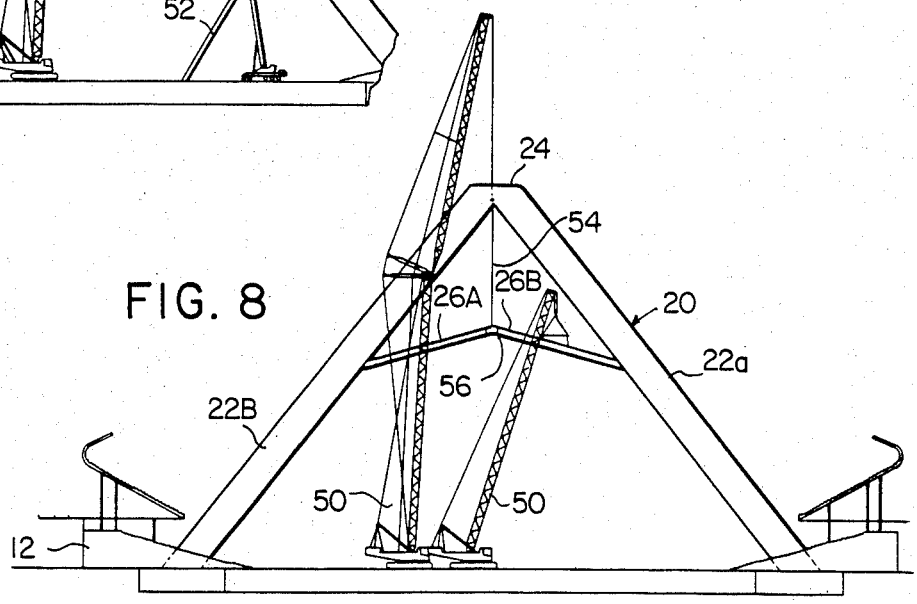

After the A-frame 20 is erected, the radial beams 26 may then be suspended. The first step in erecting the radial beams is illustrated in FIG. 8. In the preferred embodiment, a pair of opposed radial beam segments 26A and 26B are raised and suspended from the apex 24 of the A-frame via a cable 54. The radial inner ends of the beam segments are connected to the cable 54 through a compression ring 56. The radial outer ends of beam segments 26A and 26B are temporarily affixed to the legs of the A-frame.

Figure 9:
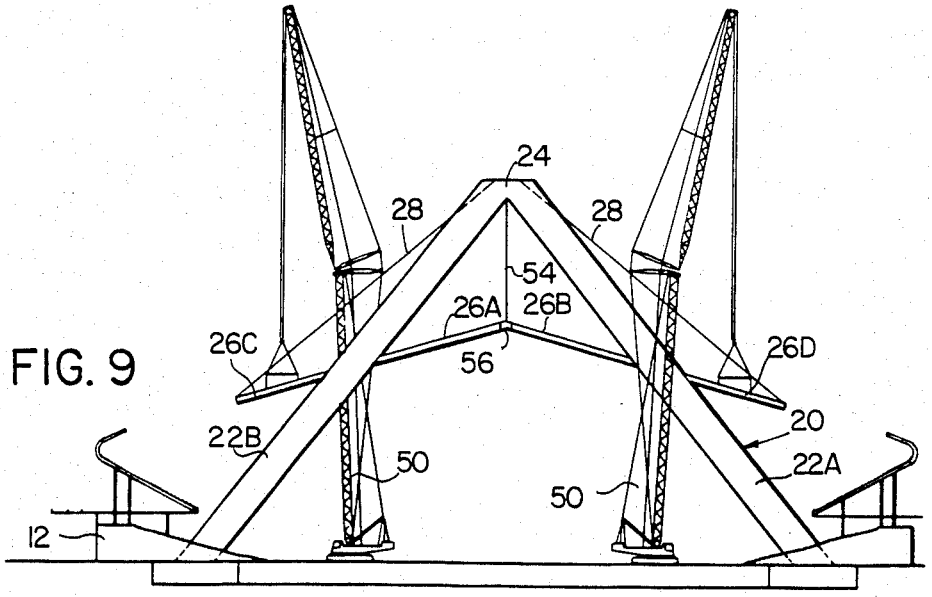
Figure 10:
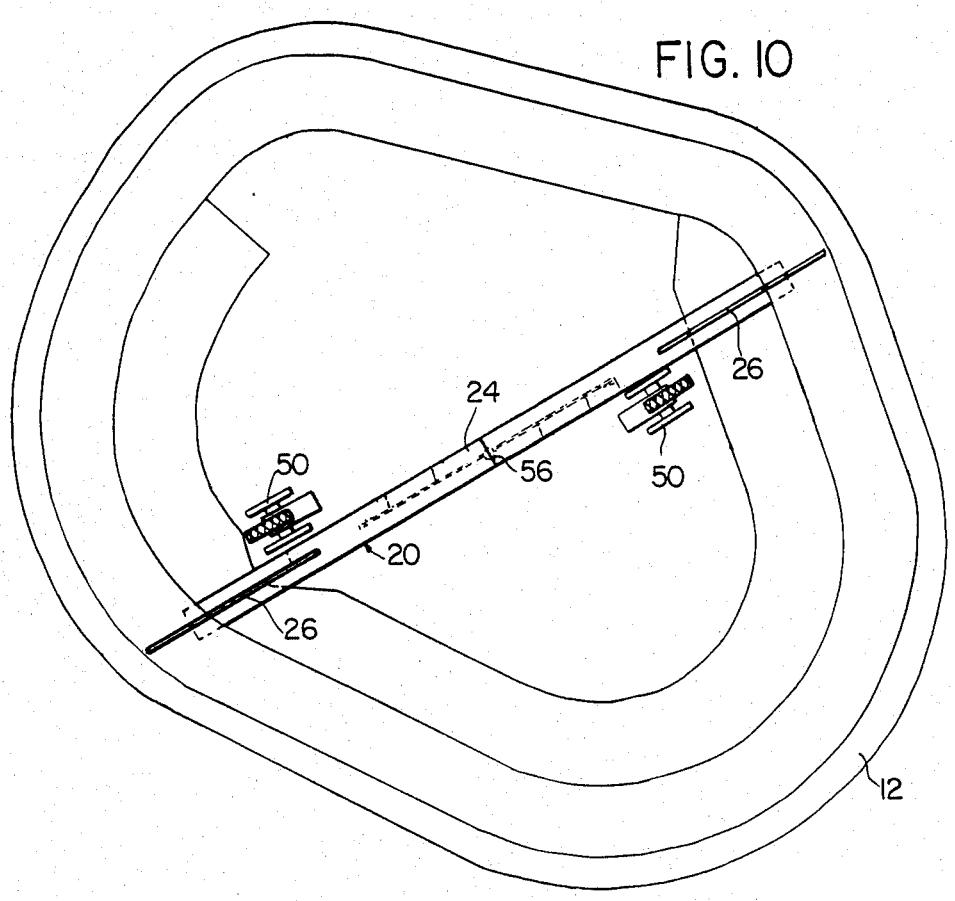
Figure 11:
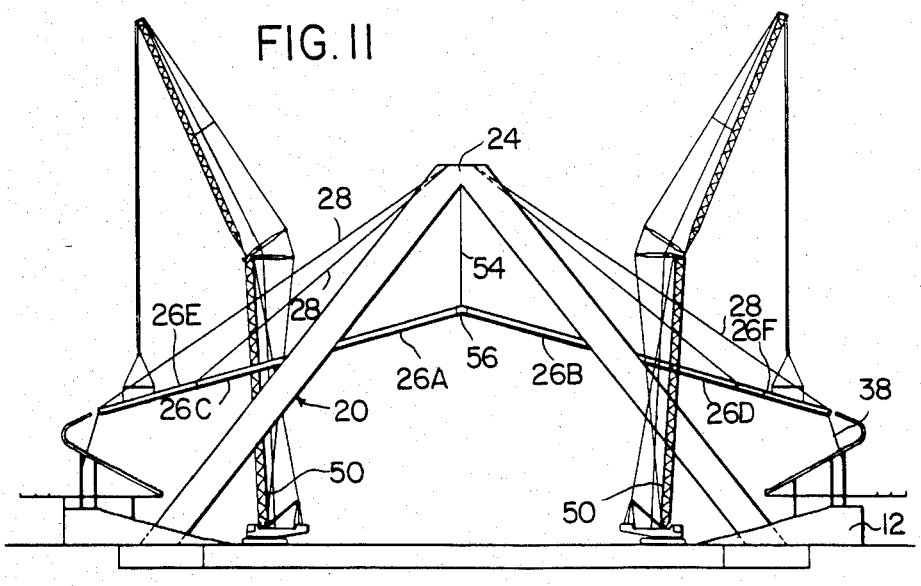

Turning to FIG. 9, it will be seen that a second pair of radial beam segments 26C and 26D are then mounted in radial alignment with the first pair of radial beam segments 26A and 26B. The radial inner ends of beam segments 26C and 26D are temporarily affixed to the legs of the A-frame, while the outer ends of the beams are supported from the apex of the A-frame by cable stays 28. As illustrated in FIG. 11, another set of radial beam segments 26E and 26F are then suspended in radial alignment with the other pairs of beams. The radially inner end of beam segments 26E and 26F are connected to the radial outer ends of beam segments 26C and 26D and supported by the existing cable stays 28. The radial outer ends of beam segments 26E and 26F are also suspended from the A-frame by similar cable stays 28.

As can be appreciated, the number of segments which define a single radial beam will depend upon the size of the stadium. It is anticipated that each of the segments of the radial beam will be supported by an individual cable stay 28. The number of cable stays used and their locations will depend upon the weight and the design load of the roof and in turn the length and size of the beams. The radial beams may be steel box girders which are large enough for the passage of a human. The radial beams may also be formed of concrete or even wood.

The temporary rigid connection of the first pair of radial beams to the tower legs of the A-frame provides support during construction. It is also possible to suspend the first set of radial beams without connection to the legs of the A-frame. In the preferred embodiment, a permanent connection is contemplated defined by a slip joint which permits the vertical movement of the beams, thereby accommodating contraction and expansion of the members. The joint should be designed such that it will not allow for the lateral movement of the beams relative to the A-frame.

After the outermost radial segment of the first pair of radial beams 26 is suspended, the beams are secured relative to the stadium. As illustrated in FIG. 11, this step may be achieved by connecting a tie down cable 38 from the radial outer end of the beam to either the stadium itself or to ground anchors adjacent the stadium. These cables are not fully tensioned until the entire structure is formed.

Figure 12:
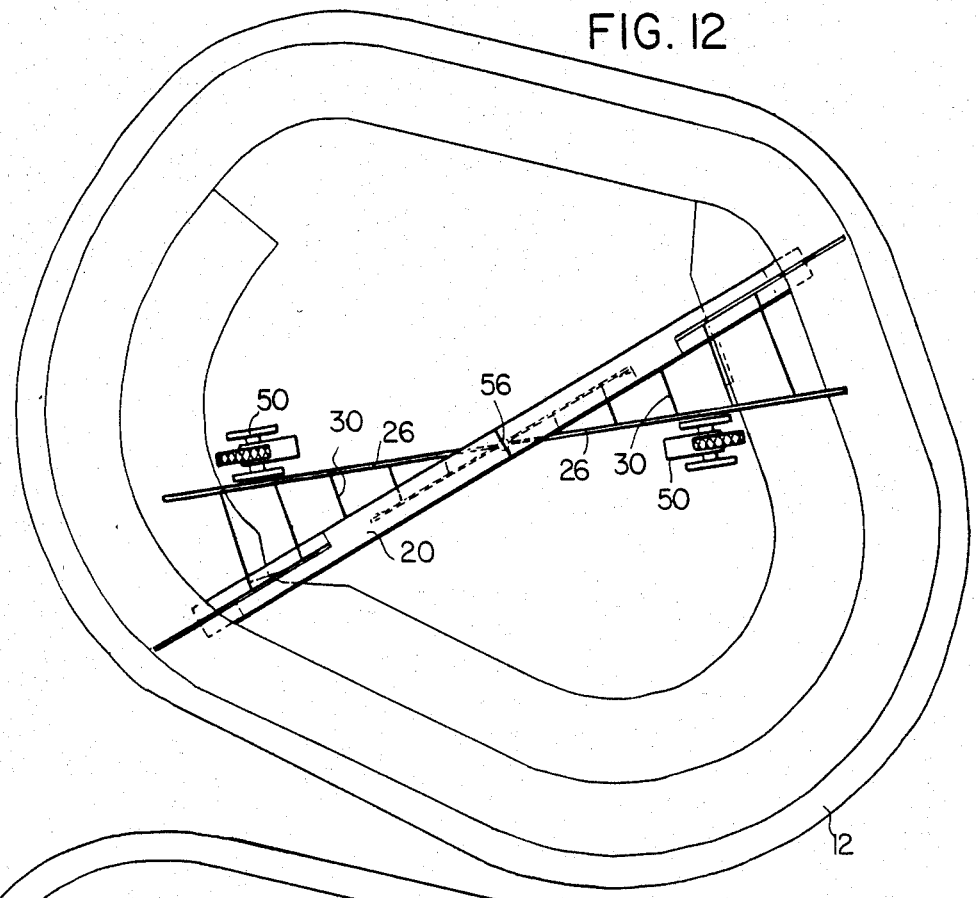
FIGS. 12 and 13 are top plan views illustrating the suspension of a second set of radial beams and the addition of chordal cross beams and purlins to the structure.
Figure 13:
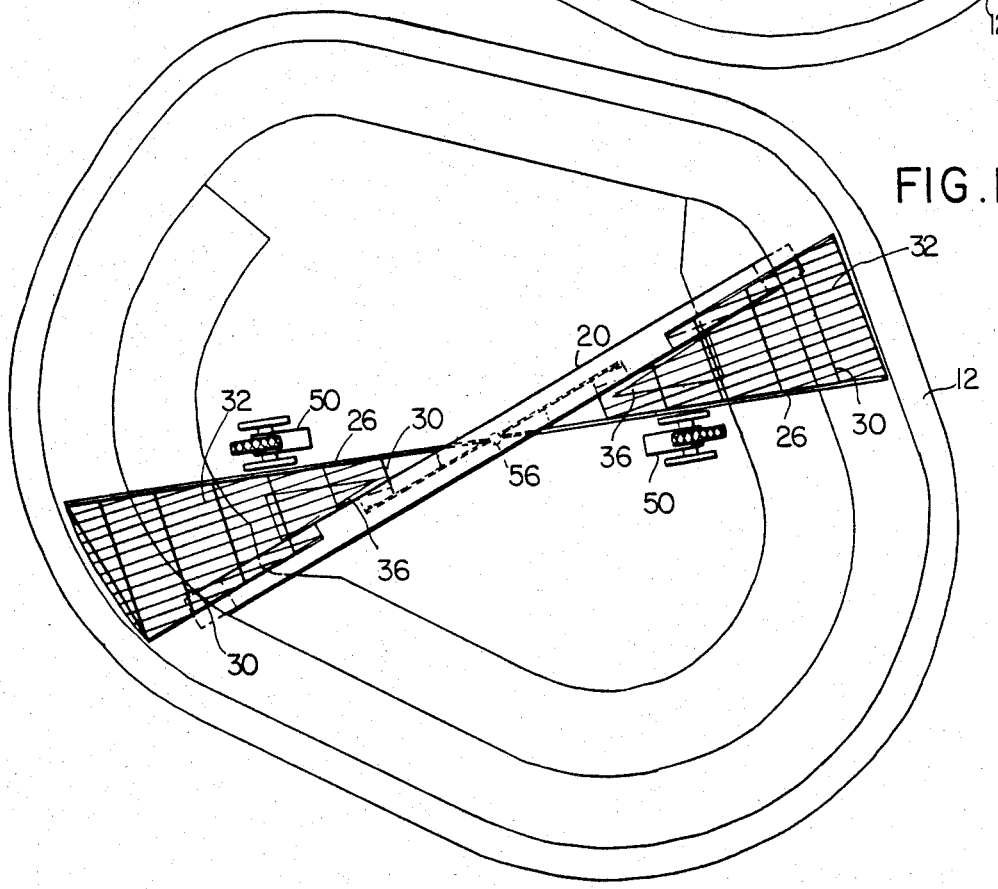

After the first pair of radial beams 26 are suspended, the cranes 50 are moved to a radially offset position to permit erection of the second set of radial beams as illustrated in FIGS. 12 and 13. The radial inner ends of the second set of radial beams 26 are connected to compression ring 56. The radial outer ends of beams 26 are supported from the apex 24 of the A-frame by cable stays 28. As pointed out above, the beams are usually formed in segments each being supported by an individual cable stay 28. The radial offset between the beams defines a triangular configuration.

After the second pair of radial beams 26 are suspended, a plurality of chordal cross beams 30 are affixed between the adjacent radial beams 26. The chordal cross beams 30 provide lateral stability to the radial beams 26, roof support and maintain the spacing between the radial beams. As illustrated in FIG. 13, after the chordal cross beams 30 are assembled, a plurality of radially extending purlins 32 are affixed to the cross beams.

Having completed a portion of the support structure it is possible to affix a covering over this triangular section. Preferably, the covering is defined by glass panels or a translucent material which would allow sunlight to pass into the stadium. In the alternative, the covering is not assembled until the entire support structure is erected.

Figure 16:
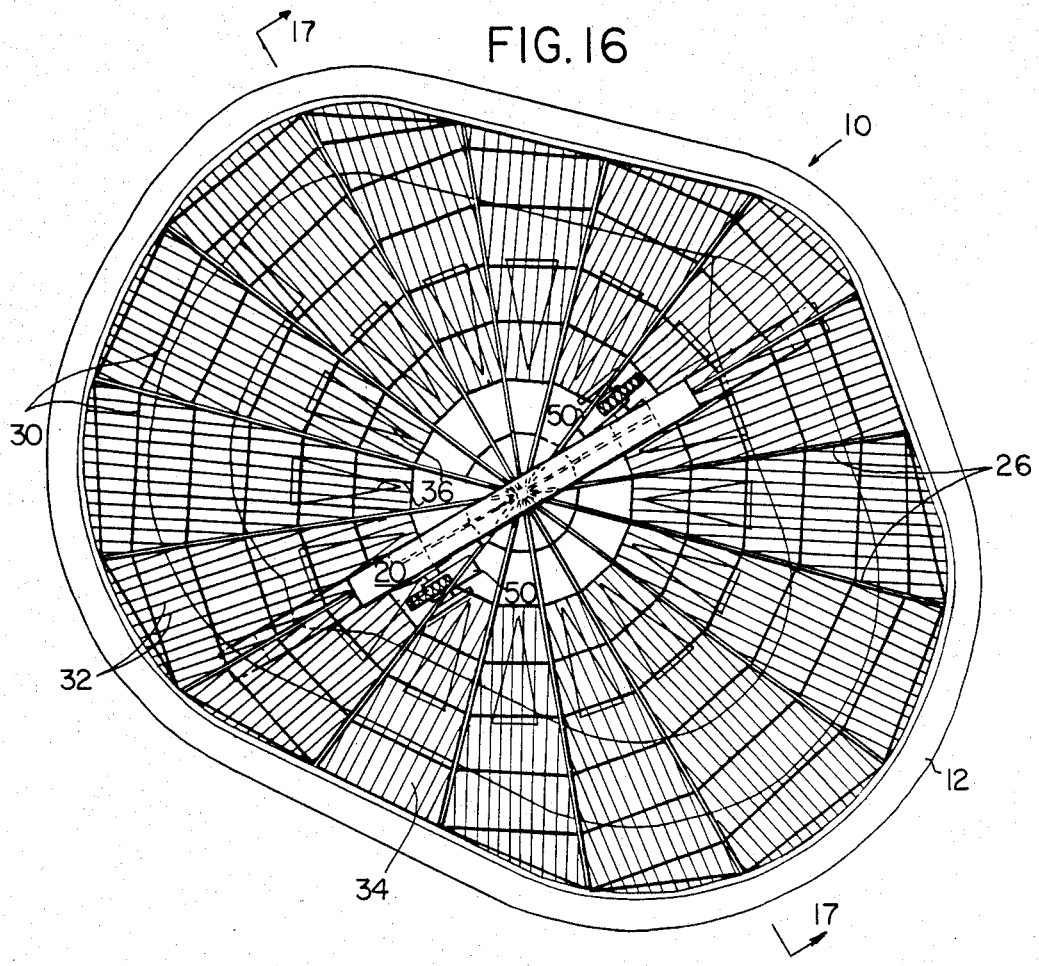

FIGS. 14 and 15 illustrate the successive steps of suspending beams 26 in a radially offset manner around the circumference of the stadium. As described above, the radial inner end of each radial beam is connected to compression ring 56, while the remainder of the radial beam is supported by one or more cable stays connected to the apex of the A-frame. As each radial beam is assembled, the triangular open section defined with the previously erected radial beam is stabilized by connecting the chordal cross beams 30 and the purlins 32. Thus, the triangular support structure is fully assembled prior to initiating the construction of the next triangular section. In this manner, a relatively stable structure can be successively erected until the stadium is fully covered as illustrated in FIG. 16. Once the entire assembly has been completed, the center cable stay 54, supporting the compression ring 56 can be removed. The tie down cables 38 along with the cable stays 28 are then precision tensioned. This action places further inward compression force on the beams directed toward the compression ring. Since the roof is spaced from the stadium by the tie down cables, the roof is free to move to some degree without damaging the stadium.

The structure assembled in accordance with the method of the subject invention can support a plurality of panels 34 for covering the stadium. As pointed out, the preferred covering would be glass, although it could be most any material. The covering can also include retractable segments 36 to allow air to enter or exit through the center of the stadium as well as to allow for exiting of noise within the stadium. Other accoutrements, such as light fixtures, access walkways, and television screens may be suspended from the structure. It is estimated that the weight of the entire structure is on the order of eleven thousand tons. It should be appreciated that the entire load of the roof structure is supported through the A-frame, rather than the walls of the stadium. By this arrangement, no extra reinforcement of the stadium walls or construction of a supporting structure is necessary.

It is to be understood that while the subject invention has been described with reference to a preferred method of assembly, other variations could be made by one skilled in the art without varying from the scope and spirit of the subject invention as defined by the appended claims.

I claim:

1. A method of constructing a roof over an existing stadium comprising the steps of:

erecting a frame having at least two tower legs and an apex, with the apex being substantially aligned with the center of the stadium and located above the highest portion of the stadium to be covered;

successively suspending pairs of opposed radial beams, with the radial inner end of each beam being affixed to a compression ring suspended from the apex of the frame and with each beam being further supported by multiple cable stays connected along the length of the beam and with each pair of radial beams being radially offset from the previously suspended pair of radial beams;

successively affixing a plurality of chordal cross beams between adjacent radial beams;

anchoring the radial beams relative to the stadium; and affixing a covering over said beams.

2. A method as recited in claim 1 wherein said step of anchoring the radial beams comprises affixing a tie down cable to the radial outer end of the beams and tensioning the cable to provide stability.

3. A method as recited in claim 2 wherein the ends of the beams are spaced from the stadium by said tie down cables to permit free movement of the roof without damage to the stadium.

4. A method as recited in claim 1 further including the step of connecting one pair of said radial beams to the legs of said frame.

5. A method as recited in claim 4 wherein said connection between the pair of radial beams and the frame allows for expansion and contraction of the radial beams and cables but restricts lateral movement of the radial beams.

6. A method as recited in claim 1 further including the step of successively affixing a plurality of radially extending purlins to said chordal cross beams.

7. A method as recited in claim 1 wherein after the radial beams are all suspended the support between said compression ring at the center of the roof and the apex of the frame is removed.

8. A method as recited in claim 1 wherein said frame is formed by tilting up its legs.

9. A method as recited in claim 1 wherein the legs of said frame are constructed by a slip cast forming operation in concrete.

10. A method as recited in claim 1 further including the step of affixing panels over the structure to enclose the roof.

11. A method as recited in claim 10 wherein said panels are made of glass.

12. A method as recited in claim 10 wherein some of said panels are retractable to permit the opening and closing of the central portion of the roof.

* * * * *